US005341124A

United States Patent [19]

Leyden et al.

[11] Patent Number: 5,341,124

[45] Date of Patent: Aug. 23, 1994

[54] MOUNTABLE PRODUCT SENSOR AND DISPLAY STAND

[75] Inventors: Roger J. Leyden, Willow Springs; Terrance Surma, Bloomingdale, both of Ill.

[73] Assignee: Se-Kure Controls, Inc., Chicago, Ill.

[21] Appl. No.: 753,304

[22] Filed: Aug. 30, 1991

Related U.S. Application Data

[63] Continuation-in-part of Ser. No. 707,014, May 29, 1991, Pat. No. 5,172,098.

[51] Int. Cl.[5] ..... G08B 13/14

[52] U.S. Cl. ..... 340/568; 340/691; 439/917

[58] Field of Search ..... 340/568, 687, 691, 693, 340/815.03; 200/512, 520, 61.42; 439/917, 502, 531, 676; 248/187

[56] References Cited

U.S. PATENT DOCUMENTS

| | | | |
|---|---|---|---|
| 3,803,577 | 4/1974 | Peterson, II | 340/568 |
| 4,064,508 | 12/1977 | Simon | 340/691 X |
| 4,455,464 | 6/1984 | Leyden | 200/61.93 |
| 4,620,182 | 10/1986 | Keifer | 340/568 |
| 4,772,878 | 9/1988 | Kane | 340/568 |
| 4,992,789 | 2/1991 | Czerwinski | 340/568 X |
| 5,072,213 | 12/1991 | Close | 340/568 X |
| 5,146,205 | 9/1992 | Keifer et al. | 340/568 |
| 5,172,098 | 12/1992 | Leyden et al. | 340/568 |

OTHER PUBLICATIONS

"Secure-Cam", Protex Security Systems, Inc. Advertisment, Nov. 1987.

*Primary Examiner*—Thomas Mullen

*Attorney, Agent, or Firm*—Wood, Phillips, VanSanten, Hoffman and Ertel

[57] ABSTRACT

An alarm system remotely detects a sensor being attached to or detached from a product. The sensor has a secured state and an unsecured state. The sensor is in the secured state when attached to the product and in the unsecured state when detached from the product. The sensor includes an indicator for indicating the state of the sensor. A detector electrically connected to the sensor determines the state of the sensor. The detector provides a control signal in response to the state of the sensor. The control signal controls the indicator. An alarm is electrically connected to the detector and is responsive to the control signal for indicating the state of the sensor.

10 Claims, 9 Drawing Sheets

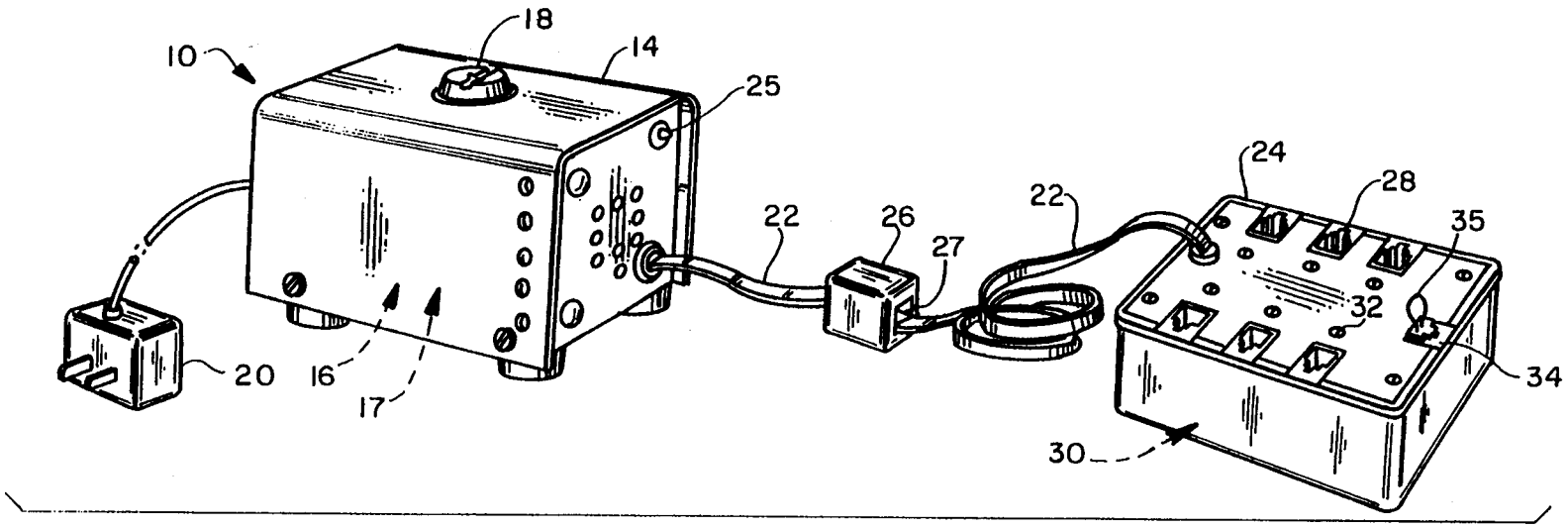
FIG. 1
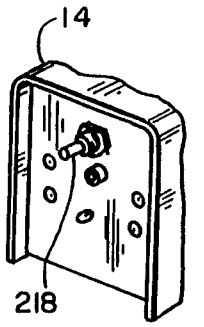
FIG. 2
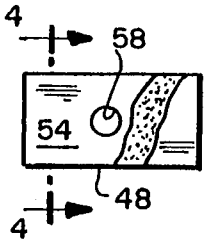
FIG. 3
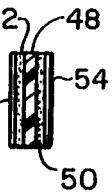
FIG. 4
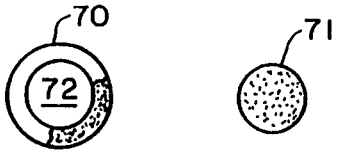
FIG. 5
FIG. 6
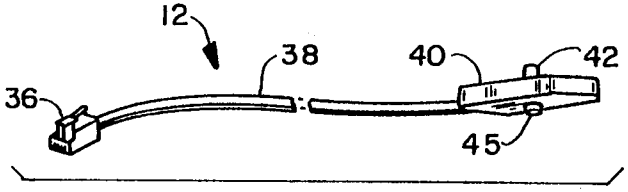
FIG. 7
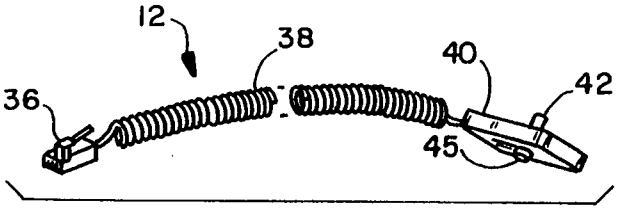
FIG. 8

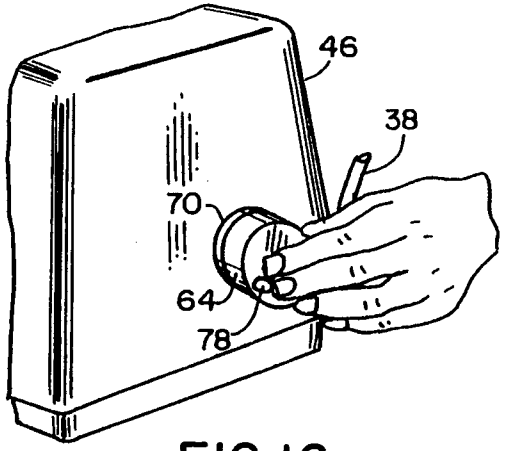
FIG. 16
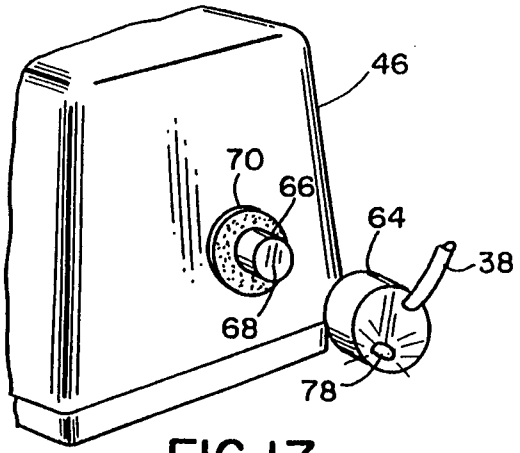
FIG. 17
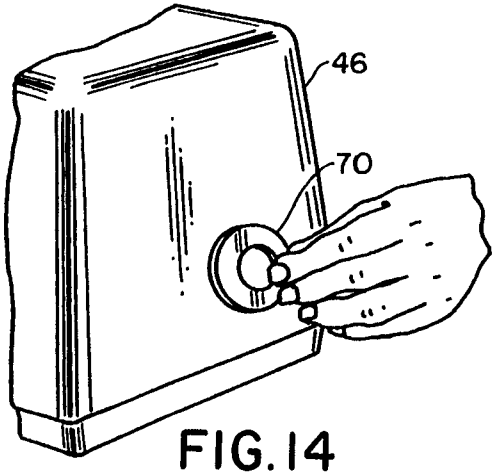
FIG. 14
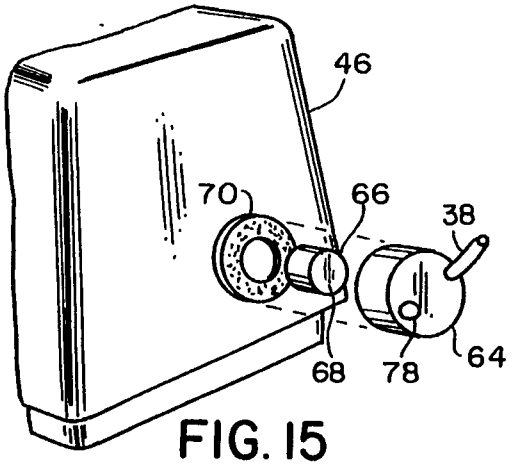
FIG. 15
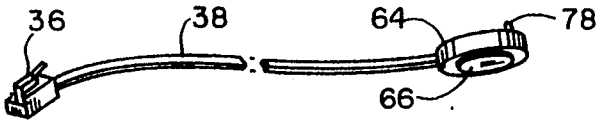
FIG. 9
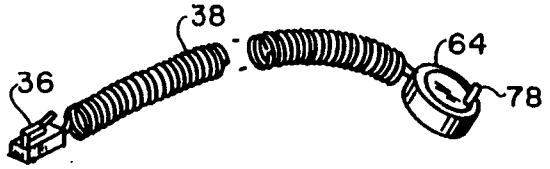
FIG. 10
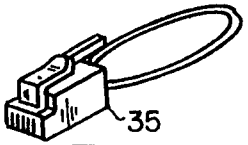
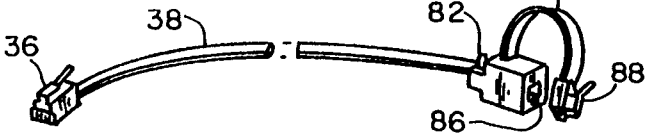
FIG. 11
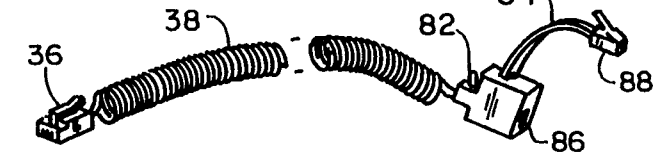
FIG. 12
FIG. 13

MOUNTABLE PRODUCT SENSOR AND DISPLAY STAND

CROSS-REFERENCE TO RELATED APPLICATION

This application is a continuation-in-part of application Ser. No. 707,014, filed May 29, 1991, now U.S. Pat. No. 5,172,098, entitled "Alarm System Sensing and Triggering Apparatus".

FIELD OF THE INVENTION

The present invention relates to security alarm and anti-theft devices and, particularly, to an improved alarm system sensing and triggering apparatus including an indicator displaying the state of a sensor which is attached directly to an article.

BACKGROUND OF THE INVENTION

In recent years, retail and wholesale merchandisers have directed substantial attention to the nagging and costly problem associated with the theft and/or damage of costly display products on their premises. With the advent of smaller and more portable electronic apparatus, the ease with which pilferers and shoplifters can quickly and easily remove such goods from display cases and display racks has intensified. At the same time, the availability of new products, such as video cassette recorders, small portable radios and televisions, calculators and the like has skyrocketed, resulting in more and more valuable products being taken or tampered with. As locks and other security devices have become more sophisticated, so too have the individuals and methods for circumventing the operation of conventional security devices and, particularly, alarm sensing devices. For example, conventional sensor devices can be circumvented by artful replacement of an exposed or otherwise slidable conducting means utilized in such devices by an alternative conducting means, such as a small electrical conducting plate, resulting in the theft of the "protected" article. Mass merchandisers often end up returning to a display case or rack only to find the otherwise reliable alarm sensor waylaid by a short-circuiting plate, which was effectively shifted into position to replace the closed circuit conductor previously attached (or which may still be attached) to the article stolen just minutes earlier.

One solution to the above-mentioned problems is shown in commonly-assigned U.S. Pat. No. 4,455,464, dated Jun. 19, 1984, which discloses an alarm system having an electrical conductor connected at one end to the alarm sensor. A plurality of sensors are connected in series to the electrical conductor. An electrical conductor connects the last sensor back to the alarm system. The sensors complete an electrical circuit which is monitored. The alarm system continually checks the sensors to determine if they have been removed from the product or tampered with. However, when one of the sensors has been removed or tampered with, it is difficult to determine which sensor. Furthermore, upon connecting each of the sensors to the products and back to the alarm circuit, it is difficult to determine if a sensor has been improperly connected to a product. Thus, when the alarm is enabled, the alarm will sound if the sensors are incorrectly applied.

The present invention provides an alarm system having sensors including an indicating means, for example, a light-emitting diode, which indicates the state of each sensor.

SUMMARY OF THE INVENTION

An object, therefore, of the invention is to provide an alarm system including a sensor having an indicating means for displaying the state of the sensor.

In the exemplary embodiment of the invention, generally, an alarm system is provided for the remote detection of a sensor being attached to or detached from a product. A sensor has a secured state and an unsecured state. The sensor is in the secured state when it is attached to the product and in an unsecured state when detached from the product. The sensor includes an indicating means for indicating the state of the sensor. A detector means is electrically connected to the sensor and determines the state of the sensor. The detector means provides a control signal in response to the state of the sensor. The control signal controls the indicating means. An alarm means is electrically connected to the detector means and is responsive to the control signal for indicating the state of the sensor.

The invention also contemplates providing a light-emitting diode with a first, second, and third display color. The alarm means also includes a sounding means for providing an alert mode. The indicating means illuminates in the first display color responsive to the secured signal and illuminates in the second display color responsive to the unsecured signal.

Another feature of the invention is the provision of a sounding means including a chirp mode. The sounding means being in the chirp mode when power supplied to the alarm means and the key means is in the off position.

A further feature of the invention is the provision of a plurality of detector means mounted in a first splitter box. A first connecting means on the first splitter box electrically connects the alarm means in the housing to the plurality of detector means in the first splitter box. A plurality of sensors are provided and associated with each detector means. This first splitter box can also include a second connecting means for connecting a second splitter box.

Still another novel feature of the invention is the provision of a sensor means having a housing with a plunger located on an external side thereof. The sensor means is attached to the product with an adhesive such that the plunger is in a depressed position when attached to the product. The depressed position corresponds to the secured state. The plunger is in an exposed position when the sensor is not applied to the product.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof may be best understood by reference to the following description, taken in conjunction with the accompany drawings, in which like reference numerals identify like elements in the Figures and in which:

FIG. 1 is a perspective view of the alarm housing, phone cord, AC adapter and splitter box;

FIG. 2 is a fragmented section of one side of the alarm housing showing the battery check button and AC adapter input jack;

FIG. 3 is a top view of an adhesive sheet utilized in fastening a sensor to a product;

FIG. 4 is a cross-sectional view of the adhesive sheet of FIG. 3 taken along the line 4—4 of FIG. 3;

FIG. 5 is a top view of an annular adhesive sheet;

FIG. 6 is a top view of a circular adhesive sheet used in conjunction with the annular adhesive sheet shown in FIG. 5;

FIG. 7 is a perspective view of a sensor showing its elongate cord and connector;

FIG. 8 is a view, similar to FIG. 7, except that the elongate cord is a retractable cord;

FIG. 9 is a perspective view of an alternate sensor design;

FIG. 10 is a perspective view of the sensor of FIG. 9 having a retractable cord;

FIG. 11 is a view of a shunt plug;

FIG. 12 is a perspective view of a sensor head showing an elongate cord and connector;

FIG. 13 is a perspective view of the sensor of FIG. 12 showing a retractable cord and connector;

FIGS. 14–16 are a perspective view of the sensor of FIG. 9 being attached to a product via the adhesive strips of FIGS. 5 and 6;

FIG. 17 is a perspective view of the sensor of FIGS. 14–16 being removed from the product;

DETAILED DESCRIPTION OF THE PREFERRED EMBODIMENT

Figure 23:
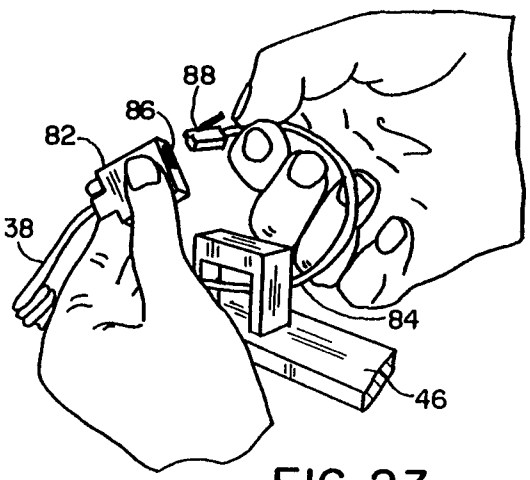
FIG. 23 is a perspective view of the sensor of FIG. 12 being attached to a product.

The concepts of this invention are exemplified in an alarm assembly 10, shown in FIG. 1, and a sensor assembly 12, shown in FIG. 7. The alarm assembly 10 includes an alarm housing 14 enclosing an alarm circuit 16 having a horn 17. A lock 18 enables and disables the alarm circuit 16 via a key (not shown). An AC adapter 20 provides a 9 volt DC voltage from a 110 VAC source. An electrical cord 22 connects the alarm circuit 16 to a splitter box 24. Alarm housing 14 also includes an LED 25 in addition to the horn 17 to indicate the state of the alarm circuit 16. The electrical cord 22 may consist of a phone cord and include a connector 26 to connect two male phone connectors 27 (one shown), one from the splitter box 24 and the other from alarm circuit 16.

Figure 25:
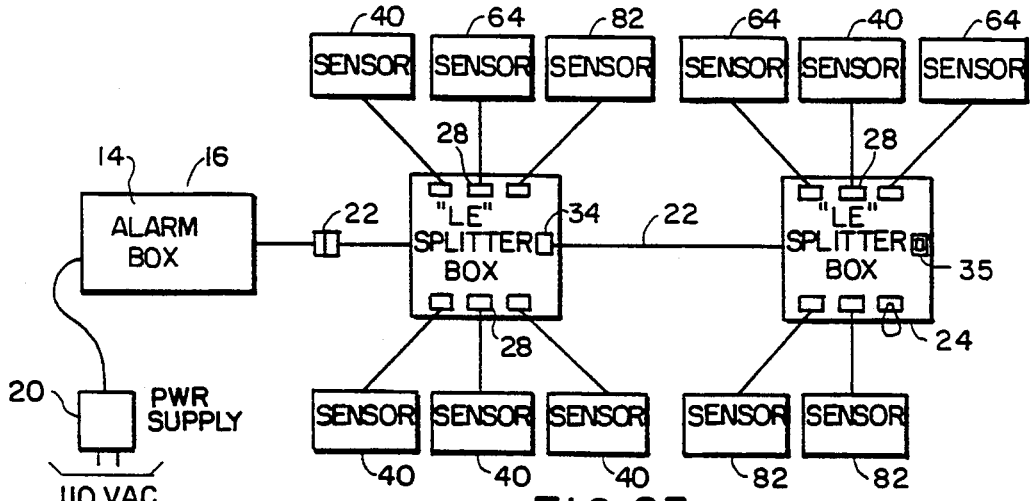
FIG. 25 is a block diagram of an electrical circuit of the alarm box, splitter box and sensors.

The splitter box 24 includes a plurality of female phone jacks 28. Each female phone jack 28 is connected to an associated detector circuit 30 and an LED 32 housed in the splitter box 24. The LED 32 displays the state of the detector circuit 30 and will be described in detail below. The splitter box 24 has six female phone jacks 28, detector circuits 30 and LED's 32 for connection to six sensor assemblies 12. An additional female phone jack 34 can be connected to additional splitter boxes 24 to increase the number of sensors 12 associated with one alarm circuit 16, as best seen in FIG. 25. A shunt plug 35 is placed in the female phone jack 34 on the last splitter box used. The shunt plug 35 is best seen in FIG. 1 and 11.

Figure 28:
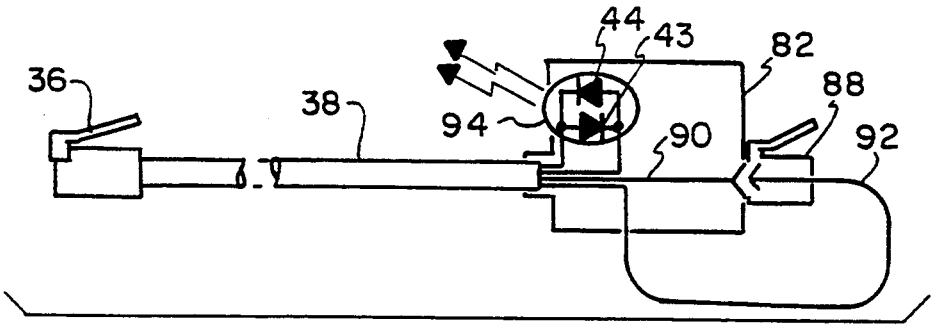
FIG. 28 is a schematic illustration of an electrical circuit of the sensor shown in FIG. 12.

The sensor assembly 12 includes a male phone jack 36, an elongate cord 38, and a sensor housing 40. The elongate cord 38 is typically a four-wire phone cord. The sensor housing 40 includes a bi-color LED (light-emitting diode) 42 for displaying the state of the sensor. The LED 42 includes two diodes 43, 44 which are connected antiparallel, as best seen in FIG. 28. The sensor housing 40 also includes a button 45 which is depressed when attached to a product 46 and released when unattached to a product. Alternatively, elongate cord 38 may be a retractable cord, as best seen in FIG. 8.

Figure 19:
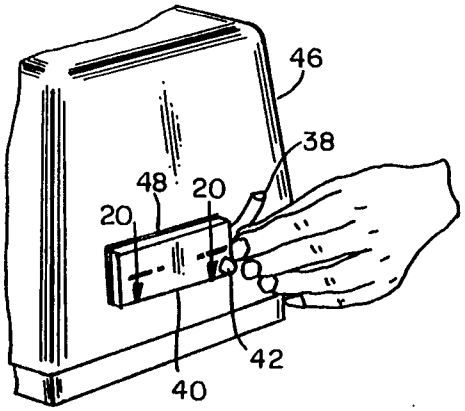

FIGS. 3, 4 and 18-21 illustrate the attachment of the sensor housing 40 to the product 46. An adhesive sheet 48 includes an adhesive layer 50,52 on the top and bottom sides of the adhesive sheet 48, respectively. A release liner 54,56 is placed over the adhesive layer 50,52, respectively. A hole 58 is formed in the adhesive sheet 48. To attach the adhesive sheet 48 to the product 46, the release liner 56 is removed and the adhesive sheet 48 is attached to the product 46 via adhesive 52. The release liner 54 is then removed, exposing adhesive 50. The button 45 of the sensor housing 40 is then aligned with the hole 58 in the adhesive sheet 48 and the sensor housing 40 is pressed against the adhesive layer 50, as best seen in FIG. 19. When the sensor housing 40 is properly attached to a product 46, the LED 42 is illuminated in a first color, for example red. When the sensor housing 40 is removed from or improperly attached to the product 46, the LED 42 is illuminated in a second color, for example green. Thus, the LED 42 on the sensor housing 40 attached to the product 46 indicates the state of the sensor.

Figure 20:
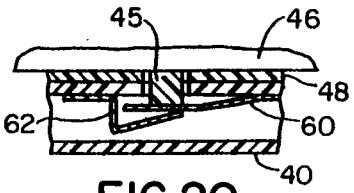
FIG. 20 is a cross-sectional view taken along the line 20—20 of FIG. 19 of the sensor adhered to a product.
Figure 21:
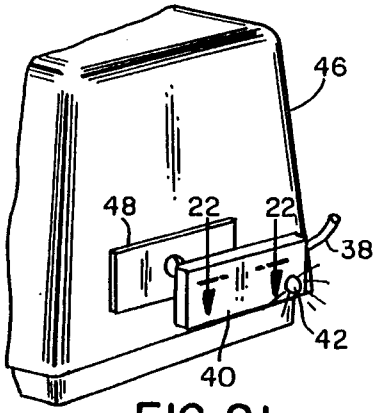
FIG. 21 is a perspective view of the sensor of FIGS. 18 and 19 being removed from a product and the LED illuminated.
Figure 22:
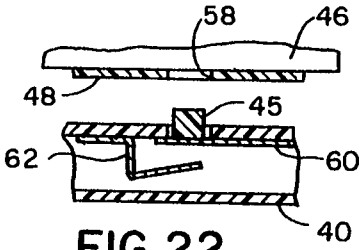
FIG. 22 is a cross-sectional view taken along the line 22—22 in FIG. 21 of the sensor removed from a product.
Figure 18:
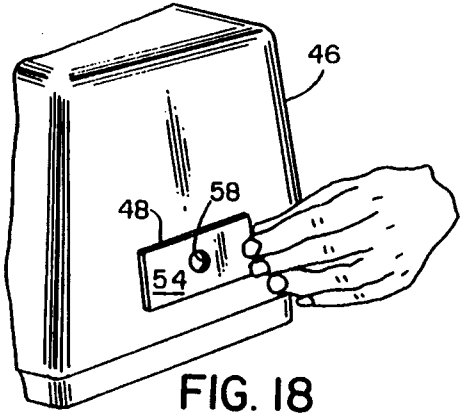
FIGS. 18 and 19 are a perspective view of the sensor of FIG. 7 being attached to the product via the adhesive sheet of FIG. 3.
Figure 26:
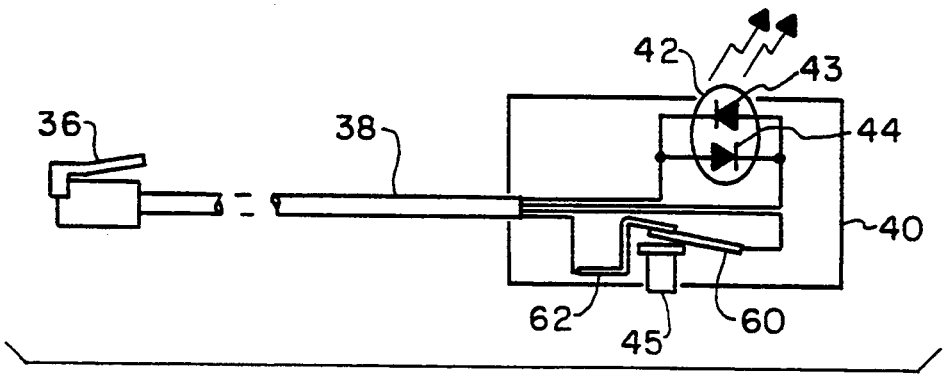
FIG. 26 is a schematic illustration of an electrical circuit of the sensor shown in FIG. 7.

FIG. 20 shows a cross-sectional view of the sensor housing 40. With the sensor housing 40 adhered to the product 46 via adhesive sheet 48, the button 45 is depressed. The depression of button 45 causes a first conductor 60 to come into contact with a second conductor 62 to complete an electrical circuit. Due to the completion of the electrical circuit, the detector circuit 30 can determine that the sensor housing 40 is attached to the product 46. As a result, LED 42 is illuminated to indicate the secured state of the sensor, as best seen in FIGS. 19,20,26. Alternatively, when the sensor housing 40 is removed from the product 46, the button 45 is released and the first conductor 60 breaks contact with the second conductor 62 to break an electrical circuit. The detector circuit 30 illuminates LED 42 to indicate the unsecured state of the sensor housing 40, as best seen in FIGS. 21,22.

Figure 27:
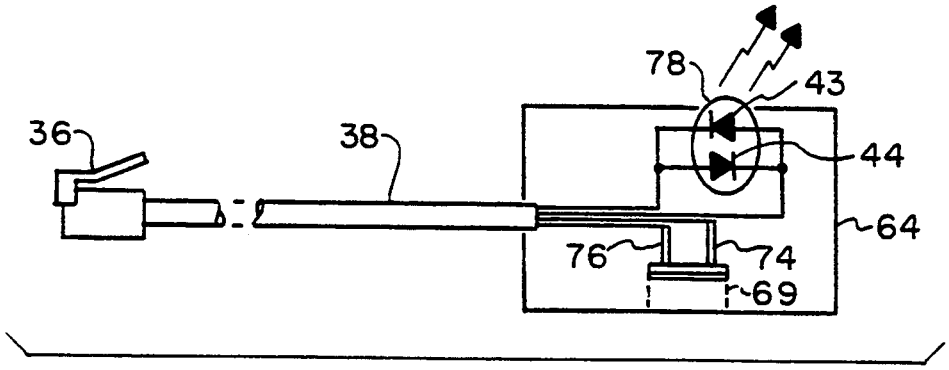
FIG. 27 is a schematic illustration of an electrical circuit of the sensor shown in FIG. 9.

An alternate embodiment of the sensor housing 40 is shown in FIG. 9 and designated 64. A short cylinder 66 has a conductive surface 68 on one side thereof, as best seen in FIG. 15. The conductive surface 68 is preferably made of a conductive black foam. The sensor housing 64 includes a cylindrical recess 69 corresponding in shape to short cylinder 66, as best seen in FIGS. 15,17,27. The sensor housing 64 is adhered to the product 46 via an annular adhesive sheet 70, as best seen in FIG. 5. The annular adhesive sheet 70 is adhered to the product 46 similar to that described with respect to the adhesive sheet 48. An additional circular adhesive sheet 71, shown in FIG. 6, is adhered to the side of short cylinder 66 opposite to the side with the conductive surface 68. The annular adhesive sheet 70 and the circular sheet 71 are multi-layer sheets, similar to the adhesive sheet 48, shown in FIGS. 3 and 4. Short cylinder 66 is then adhered in a hole 72 in the annular adhesive sheet 70.

The conducting surface 68 of short cylinder 66 connects a first and a second conductor 74 and 76, respectively, when the sensor housing 64 is fully seated upon the short cylinder 66. As a result of the connection between first and second conductors 74 and 76, the detector circuit 30 illuminates LED 78 to a first color, for example red, to indicate that the sensor is secured. When the sensor housing 64 is removed or tampered with, conducting surface 68 breaks the connection between first and second conductor 74 and 76 and the detector circuit 30 illuminates LED 78 to a second color, for example green, to indicate that the sensor is unsecured.

In a further embodiment of the sensor housing 40, shown in FIGS. 12 and 13, a sensor housing 82 includes an elongate strip 84. Sensor housing 82 includes a female phone jack 86. Elongate strip 84 includes a male phone jack 88 which is threaded through a portion of product 46, as best seen in FIG. 23, and then fastened into the female phone jack 86. The connection of the male phone jack 88 to the sensor housing 82 connects a first and second conductor 90,92, respectively, to complete a circuit. Alternatively, the connection of male phone jack 88 to the housing 82 could break a circuit and obtain similar results with a modified detector circuit. The detector circuit then illuminates LED 94 to a first color, for example red. When the male phone jack 88 is removed from the female phone jack 86, or the elongate strip 84 is tampered with, the circuit is broken. The detector circuit then illuminates the LED 94 to a second color, for example green.

Figure 24:
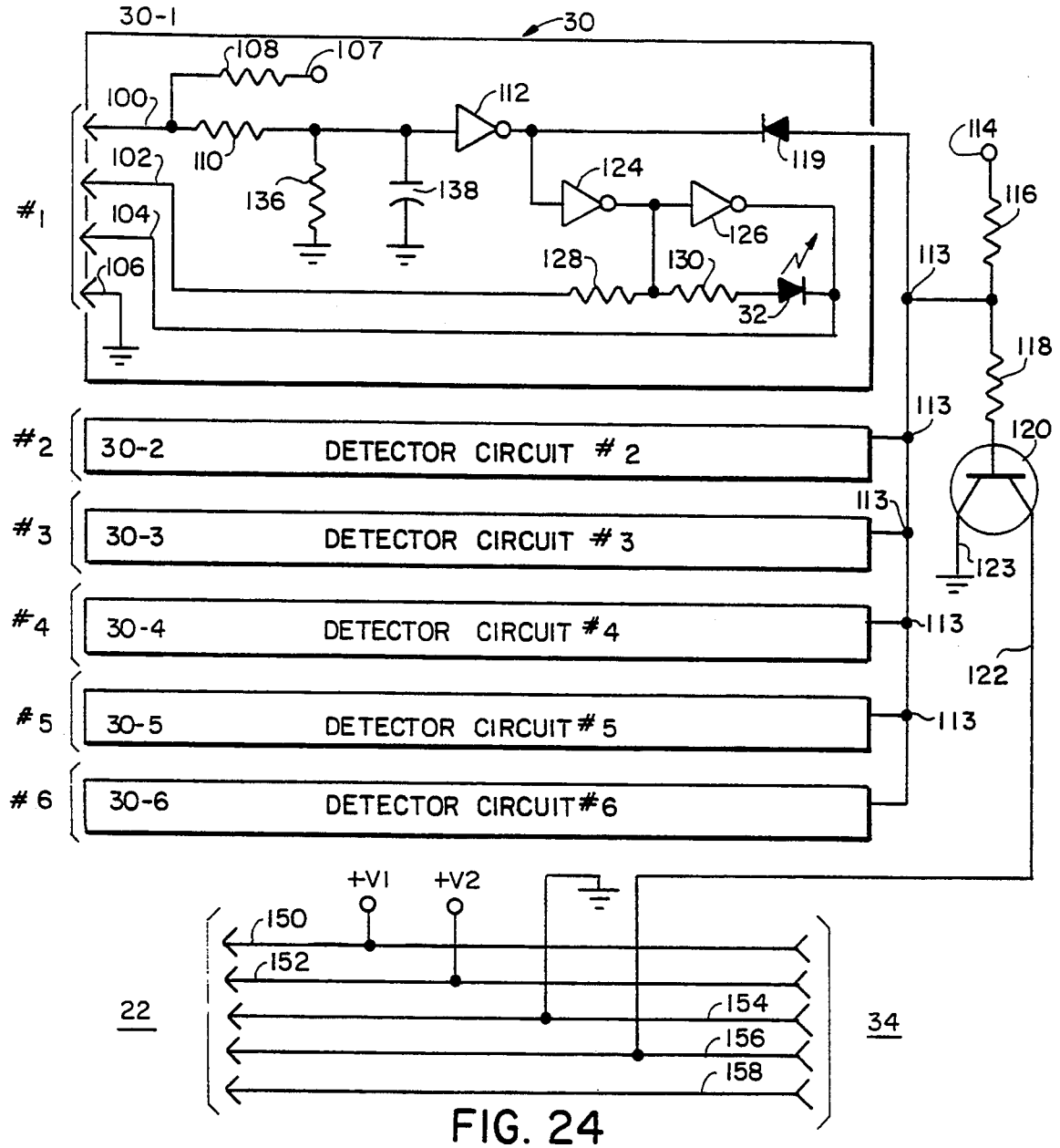
FIG. 24 is a schematic illustration of an electrical circuit of the splitter box and detector circuit.

The detector circuit 30 is illustrated in greater detail in FIG. 24. The detector circuit 30 is described in conjunction with sensor assembly 12, see FIG. 26, but is readily usable with sensors 64 and 82 or any combination of the three sensors. The detector circuits 30-2 through 30-6 have the same circuit components as shown in 30-1 (described below). Detector circuit 30-1 has four terminals, labelled 100, 102, 104, and 106, which represent the female phone jack 28 connected to the sensor's male phone jack 36 in use. The bi-color light-emitting diode 42 from the terminal sensor housing 40, see FIG. 26, is connected across the leads which, through the jacks 36 and 28, is connected to the terminals 102 and 104. The terminals 100 and 106 are connected via the jacks 36 and 28 to the first and second conductors 60,62 which are connected and disconnected by button 45.

The detector circuit 30 includes a +V voltage source 107 connected to a 330 kohm resistor 108. The resistor 108 is connected to terminal 100 and a 1.3 Mohm resistor 110. The resistor 110 is connected to the input of an inverter 112. A cathode of a diode 119 and the output of inverter 112 are both connected to an input of an inverter 124. The output of the inverter 124 is connected to an input of an inverter 126, a 2.7 Kohm resistor 128, and a 2.7 Kohm resistor 130. The resistor 130 is connected at its other end to the anode of the LED 32. A cathode of the LED 32 is connected to terminal 104 and the output of inverter 126. The other end of resistor 128 is connected to terminal 102. The input of inverter 112 is also connected to an 8.2 Mohm resistor 136 and a 0.047 microfarad capacitor 138. Terminal 106 is connected to ground.

An anode of the diode 119 of each detector circuit 30-1 through 30-6 is connected to a common node 113. A second +V voltage source 114 is connected through a 33 Kohm resistor 116. The resistor 116 is then connected to a 1 Kohm current limiting resistor 118, an anode of the diode 119, and to additional detector circuits 30 in the splitter box 24. The current limiting resistor 118 is also connected to a base of a pnp transistor 120. The transistor 120 includes an emitter 122 and a collector 123 which is connected to ground. Note that each splitter box 24 includes six detector circuits (30-1 through 30-6), but only one transistor 120 and its associated resistors 116,118.

The combination of the resistor 110, the resistor 136, and the capacitor 138 forms a filter network for static dispersal from the sensor. The filter network also protects the input of the inverter 112.

When first and second conductors 60,62 are not in contact, the voltage source 107, through the resistor 108, pulls terminal 100 and the resistor 110 high to cause the inverter 112 output to go low. Because the inverter 112 has a low output and the source 114 forward biases diode 119 through the resistor 116, the pnp transistor 120 is turned on and begins conducting. As a result of the transistor 120 conducting, emitter line 122 is pulled low through the conducting transistor 120 to ground. LED 32 on the splitter box 24 will be illuminated to a first color, for example green.

When the output of the inverter 112 goes low, it pulls the input of an inverter 124 low. The output of inverter 124 then goes high, which causes the output of an inverter 126 to go low. With inverter 124 output high and inverter 126 output low, current flows through the resistor 130, to forward bias the LED 32 on the splitter box 24 and illuminate it in a first color, for example green. Current also flows from the terminal 104 to the terminal 102 forward biasing the diode 43, illuminating it in a first color, for example, green. Diode 44 is reverse biased and, therefore, does not emit light. LED 32 on splitter box 24 and LED 42 on sensor assembly 12 are illuminated in the first color green. As a result, the user is alerted to the fact that the sensor is either not attached, or is installed improperly.

When the first and second conductors 60,62 are in contact in the sensor housing 40, resistor 108 and resistor 110 are pulled to ground by the short circuit between node 100 and 106. Since node 100 is grounded, the input to the inverter 112 through the resistor 110 is low. As a result, diode 119 is reverse biased and thus not conducting. The base of transistor 120 is pulled high by the source 114, resistor 116 and the current-limiting resistor 118. Since the base of the transistor 120 is pulled high, transistor 120 becomes nonconducting and, as a result, emitter 122 is an open circuit.

When the output of the inverter 112 goes high, the output of inverter 124 goes low. The low output of inverter 124 causes the output of inverter 126 to go high. With the output of inverter 124 low and the output of inverter 126 high, current cannot flow through the resistor 130 because LED 32 is reverse biased. Since LED 32 is reverse biased, it is not illuminated. Current flows through the resistor 128. Current then flows from terminal 102 to terminal 104 forward biasing diode 44 and reverse biasing diode 43. Thus, LED 42 on sensor assembly 12 is illuminated to a second color, for example red. Since the sensor assembly is secured, the alarm will not sound.

The electrical cord 22 connects the alarm circuit 16 located in the alarm housing 14 to the splitter box 24. The electrical cord 22 contains at least five electrical lines. A first line 150 carries a +V1 voltage to inverter 112 (connection not shown) and to voltage source 107 and 114. A second line 152 provides a secondary positive voltage +V2 signal which supplies inverters 124,126 (connection not shown). Line 154 is a common ground for the system. Line 156 is connected to the emitter 122 of transistor 120. Lines 156,158 provide a signal feedback to the alarm circuit 16 to cause the alarm to sound. All of the lines 150–158 are connected through the splitter box 24 from the electrical cord 22 (where it meets the splitter box 24) to female phone connector 34. Female phone connector 34 can then be connected to additional splitter boxes 24, as best seen in FIG. 25.

Figure 30:
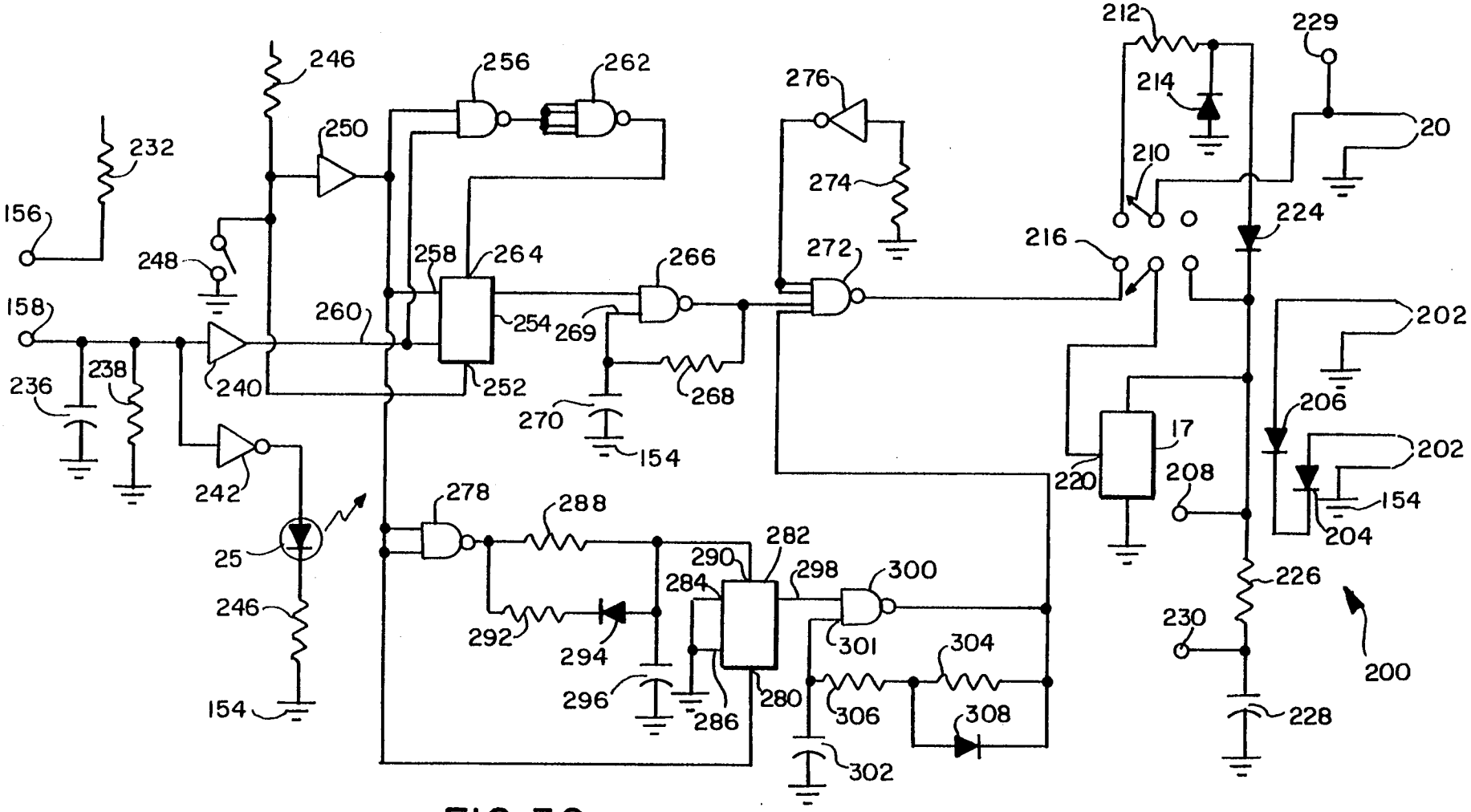
FIG. 30 is an electrical schematic of the alarm circuit and power supply.

FIG. 30 is an electrical schematic of the alarm circuit 16 and its associated power supply 200. Auxiliary power is provided by two 9 volt batteries 202 which forward bias a first diode 204 and a second diode 206 and apply 9 volts to node 208. The +V1 voltage line 150 (FIG. 24) is connected to node 208. AC adapter 20 provides 10–22 volts when energized. The positive node of AC adapter 20 is connected through a normally-closed switch 210 and through a 100 ohm resistor 212. A 9 volt zener diode 214 restricts the AC adapter output to 9 volts. Normally-closed switch 210 is operatively associated with a normally-closed switch 216 through a push-button 218, as best seen in FIG. 2. The push-button 218 is a double pole, double throw pushbutton switch which changes the state of switches 210 and 216. When button 218 is pushed, the AC adapter is disconnected and a horn control line is connected to node 208. Push-button switch 218 tests the status of the batteries 202 and a horn 17.

The 9 volt signal provided by the AC adapter 20 passes through a blocking diode 224 and is connected to node 208. The three diodes 204,206, and 224 operate as blocking diodes. If the AC adapter 20 is not powered, but connected, the batteries cannot discharge through the AC adapter 20. Also, if the AC adapter 20 is energized, it cannot charge the batteries 202, thereby shortening their life or "cooking" them. Since the batteries 202 are not utilized while the AC adapter 20 is energized, their battery life will be increased. Additionally, if the AC adapter 20 is not connected or not energized, and one battery has a greater potential than the other battery, the battery with the greater potential will not try to charge the battery with the lower potential. When the battery with the higher potential discharges to a potential that is equal to the battery with the initial lower potential, both batteries will then feed power to the circuit.

Node 208 is connected to a 10 ohm resistor 226 and a 100 microfarad capacitor 228 which is connected to common circuit ground 154. A node 230 is located between the resistor 226 and the capacitor 228. The secondary +V2 voltage signal line 152, see FIG. 24, connects to a node 229.

Node 230 is also connected through a 22 Kohm resistor 232 to line 156. The shunt plug 35 connects lines 156 and 158 on the last splitter box 24 used. The shunt plug 35 completes the circuit. Line 158 is filtered by .01 microfarad capacitor 236 and a 220 Kohm resistor 238 and is then fed to the input of inverters 240,242. The output of inverter 242 is connected to an anode of light-emitting diode 25. The cathode of light-emitting diode 25 is connected to a 510 ohm resistor 246 which is connected to ground 154. Light-emitting diode 25 is mounted on alarm housing 14, as best seen in FIG. 1. If the voltage loop from node 230 through resistor 232 down line 156 through the splitter boxes 24 and back to line 158 through the use of plug 35 is either an open circuit or ground, LED 25 is powered causing it to light and indicate either an open loop circuit or that one or more of the sensors are not applied properly.

Node 230 is also connected through a 4.7 megaohm resistor 246 and a single pole, single throw switch 248 which is connected to ground 154 at its other contact, Switch 248 is operated by a key (not shown) in lock 18, Resistor 246 is also connected to the input of inverter 250 and to the reset pin 252 of a D-type flip-flop 254, The output of inverter 250 is connected to the input of NAND gate 256 and to the data pin 258 of flip-flop 254, Inverter 240 is connected to the input of NAND gate 256 and the clock pin 260 of flip-flop 254, The output of NAND gate 256 is connected to four inputs of a quad input NAND gate 262, The output of NAND gate 262 is connected to a direct set pin 264 on the flip-flop 254, The output of flip-flop 254 is connected to a dual input NAND gate 266, The output of NAND gate 266 is connected through a 220 Kohm resistor 268 to another input 269 of NAND gate 266, The input 269 is connected to a 4.7 microfarad capacitor 270, The output of NAND gate 266 is connected to an input of quad input NAND gate 272, A 68 Kohm resistor 274 is connected to the input of an inverter 276, The output of inverter 276 is connected to two inputs of NAND gate 272.

The output of inverter 250 is also connected to both inputs of a dual input NAND gate 278 and a reset pin 280 of a D-type flip-flop 282, A data pin 284 and a clock pin 286 of flip-flop 282 are both connected to ground, The output of NAND gate 278 is connected through a 4.7 megaohm resistor 288 to a set pin 290 of flip-flop 282, A 10 Kohm resistor 292 and a diode 294 are connected in parallel across a resistor 288, A 22 microfarad capacitor 296 is connected between set pin 290 and ground 154, The output of flip-flop 282 is connected to an input 298 of a dual input NAND gate 300, A second input 301 of NAND gate 300 is connected through a 100 microfarad capacitor 302 to ground, The output of NAND gate 300 is connected through a 1 megaohm resistor 304 and a 2.2 Kohm resistor 306 back to the input 301 of NAND gate 300, A diode 308 is connected in parallel across resistor 304, The output of NAND gate 300 is connected to an input of NAND gate 272. The output of NAND gate 272 is connected through switch 216 to the horn control line 220.

Figure 29:
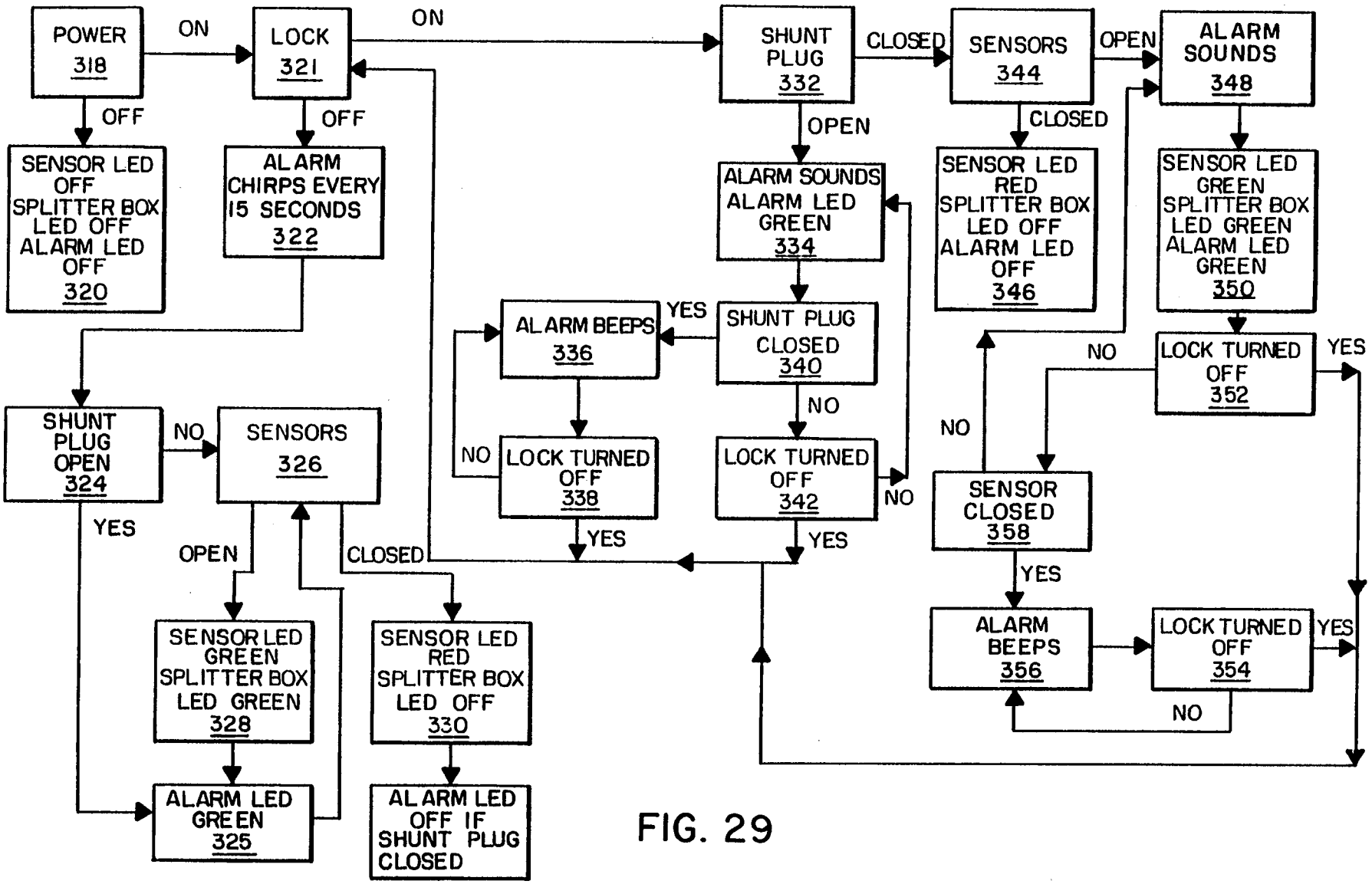
FIG. 29 is a flow chart of the operation of the alarm circuit, detector circuit and sensors.

FIG. 29 is a block diagram illustrating the operation of the alarm assembly 10. As shown in the block diagram of FIG. 29, with the power off as determined in block 318, the bi-color sensor LED 42, the associated LED 32 on the splitter box 24, and the LED 25 on the alarm housing 14 are off as described in block 320.

With the power on as determined in block 318 and the lock in the off position as decided in block 321, the alarm chirps every 15 seconds to alert the user that the alarm is not enabled, as described in block 322. If the shunt plug 35 is not inserted into the last splitter box 24 as decided in block 324, LED 25 on the alarm housing 14 will be green as described in block 325. If the sensor assemblies are either improperly attached to the product 46 or are removed from the product 46 as determined in block 326, the LED 42 on the sensor assembly 40, the associated LED 32 on the splitter box 24, and the LED 25 on the alarm housing 14 will all be green as described in blocks 325 and 328. If the sensor assemblies 40 are properly attached and the shunt plug 35 is in place in the last splitter box 24 as determined in block 326, LED 42 on the sensor assembly 40 will be red, and the LED's 32 on the splitter box 24 and the LED 25 on the alarm housing 14 will be off as described in blocks 330 and 331.

If the power is on as determined in block 318, the lock 18 is in the on position as determined in block 321, and the shunt plug 35 is not placed in the female phone jack 34 on the last splitter box 24 as determined in block 332, the horn 17 is on and LED 25 on the alarm housing 14 is green as described in block 334. If the shunt plug 35 is then inserted into female phone jack 34 as determined in block 340, the horn 17 beeps in an on/off pattern until the lock 18 is turned to the off position as described in block 336. If the shunt plug 35 is not inserted into female phone jack 34 as determined in block 340, the alarm will continue to sound until the lock 18 is turned to the off position as determined in block 342.

If the shunt plug 35 is placed in the female phone jack 34 on the last splitter box 24 as determined in block 332, and the sensor assemblies 40 are properly positioned on the products 46 as determined in block 344, the sensor LED 42 is red, the splitter box LED's 32 and LED 25 on the alarm housing are both off as described in block 346.

If the power is on as determined in block 318, the lock 18 is in the on position as determined in block 321, shunt plug 35 is placed in the female phone jack 34 on the last splitter box 24 as determined in block 332, and the sensors are open as determined in block 344, the horn 17 connected to the alarm circuit 16 is on as described in block 348. The LED 42 on the sensor assembly 40, the associated LED 32 on the splitter box 24, and the LED 25 on the alarm housing 14 are all green as described in block 350.

If the sensor assembly 40 is reattached to the product 46, or the button 45 is depressed as determined in block 358, the alarm circuit 16 will cause the horn 17 to beep until the lock 18 is turned to the off position as described in block 356. Otherwise, horn 17 will continue to sound until the lock 18 is turned to the off position.

Figure 31A:
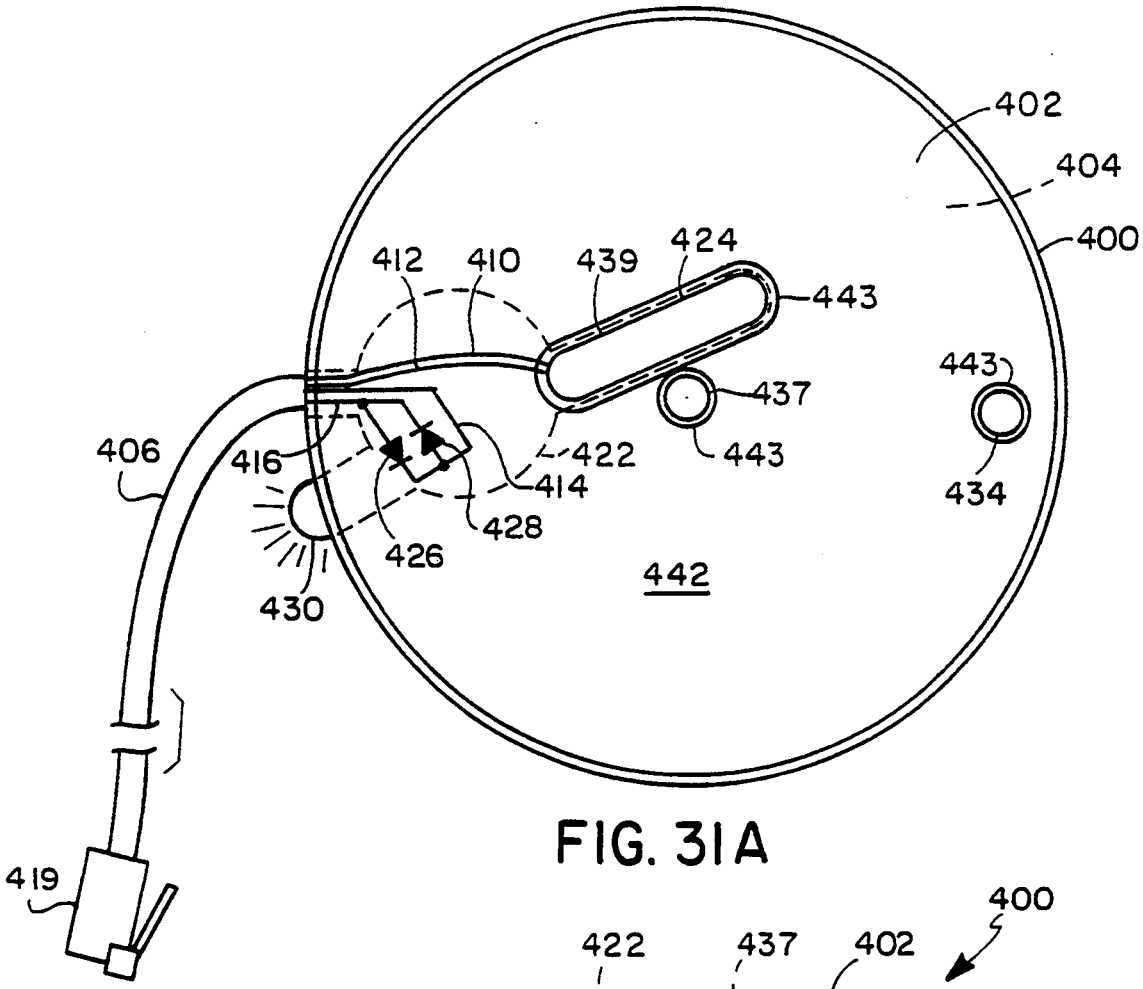
FIG. 31A is a top view of an alternate sensor showing its elongate cord and connector.
Figure 31B:
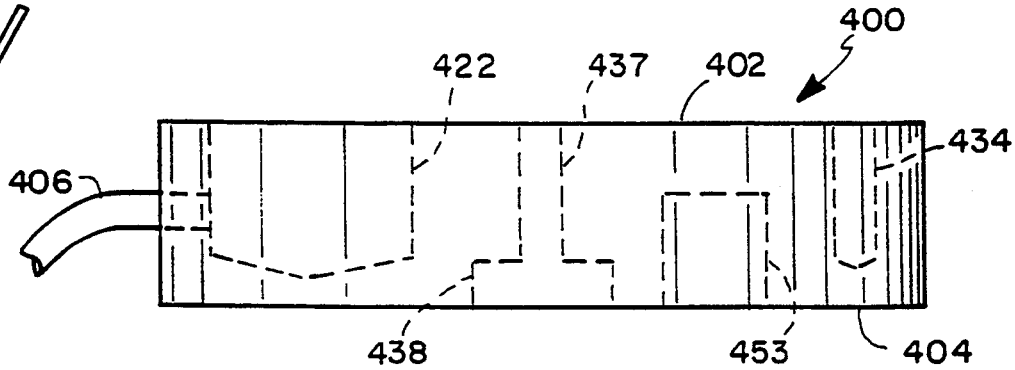
FIG. 31B is a side view of a housing block of the sensor shown in FIG. 31A.
Figure 31C:
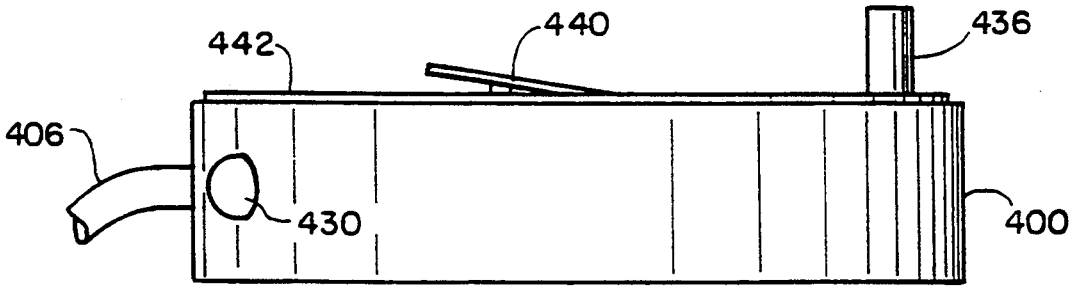
FIG. 31C is a side view of the sensor of FIG. 31A.

FIGS. 31A–C show an alternate sensor having housing block 400 with a top side 402 and a bottom side 404. While the sensor housing block 400 is shown as a flat cylinder, other shapes can be utilized with equal utility.

An elongate cord 406 houses a first, second, third and fourth elongate conductor 410, 412, 414 and 416, respectively, similar to the elongate conductors described with respect to the sensor housing 82. A male phone connector 419 connects the first, second, third and fourth conductors 410, 412, 414, 416, respectively, to the detector circuit 30 in use (via splitter box 24). The first, second, third and fourth electrical conductors 410, 412, 414, 416, respectively, extend from the detector circuit to a desired position for the product.

FIGS. 31A and 31B show a key-shaped first counterbore 422 in the top side 402 of the sensor housing block 400 to accommodate a limit switch 424 and first and second diodes 426, 428 of an indicator 430. The third and fourth electrical conductors 414 and 416, respectively, are connected to the two diodes 426, 428 connected antiparallel, as described in conjunction with FIG. 28. A second counterbore 434 in the top side 402 of the sensor housing 400 accommodates a mounting peg 436, as best seen in FIG. 31C. The mounting peg 436 prevents the sensor housing 400 from being rotated on the product. A through bore 437 with a counterbore 438 on the bottom 404 of the housing 400 is used to mount the sensor on a product, as described in greater detail below.

The first and second electrical conductors 410, 412, respectively, are attached to a body 439 of the limit switch 424. The body 439 of the limit switch 424 is received in the key-shaped counterbore 422. The limit switch 424 includes an actuator 440 extending from the top side 402 of the sensor housing block 400 which electrically connects the first and second conductors 410, 412 when the sensor housing block 400 is mounted to a product. When the sensor housing block 400 is removed from the product, the actuator 440 breaks contact between the conductors 410,412. Alternatively, if the elongate conductors housed in the elongate cord 406 are tampered with, for example, by cutting the elongate cord 406, the first and second conductors 410, 412, respectively, are disconnected. The detector circuit 30 detects the presence or absence of an electrical connection between the first and second electrical conductors 410, 412, respectively, and operates as described above with respect to sensor housing 82.

The sensor housing 400 includes a layer 442 of protecting material, for example vinyl, located on the top side 402 thereof, for protecting a mounting surface on the product. Access holes 443 are cut from the layer 442 to provide clearance, for example, for the actuator 440 of the limit switch 424.

Figure 32:
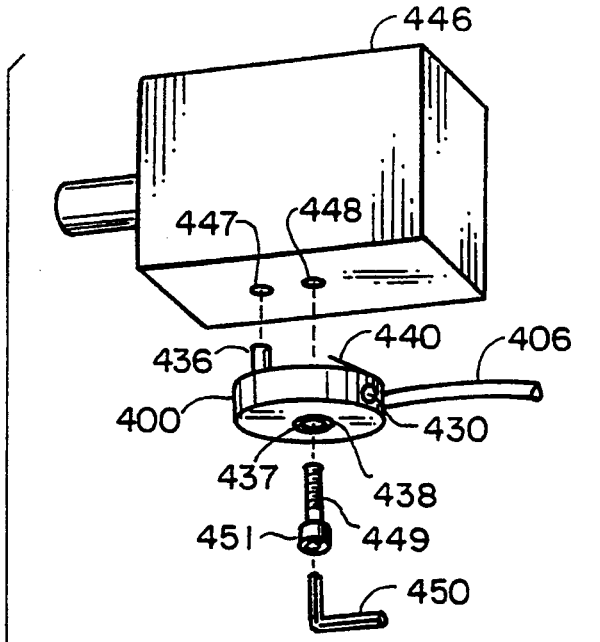
FIG. 32 is a perspective view of the sensor of FIG. 31 being attached to a product by a fastener.

FIG. 32 shows the sensor housing 400 being attached to a product 446 having mounting holes 447, 448 for receiving the peg 436 and a fastener 449, respectively. The housing 400 is aligned with the product 446 such that the counterbore 438 is facing away from the product 446 so that the through bore 437 receives a shaft of the fastener 449 and the counterbore 438 allows clearance for a head of the fastener 449. The peg 436 is aligned with the hole 447 and the throughbore 437 is aligned with the hole 448. The fastener 449 is then screwed into place by a tool 450, for example, an allen wrench. Since the actuator 440 of the limit switch 424 is located between the sensor housing 400 and the product 446, the actuator 440 is in a closed position which causes the first and second conductors 410, 412 to be in contact. When the elongate cord 406 is cut or the sensor housing 400 is removed from the product 446, contact between the first and second conductors 410, 412 is broken. The detector circuit 30 detects the presence or absence of an electrical connection between the conductors 410, 412. Once the housing 400 is mounted to the product 446, for example a camcorder, the housing 400 cannot be rotated about an axis defined by the fastener 445 due to the peg 443. A head 451 of fastener 449 is fully received in the counterbore 438 so that the head 451 does not extend past the bottom side 404.

Figure 33:
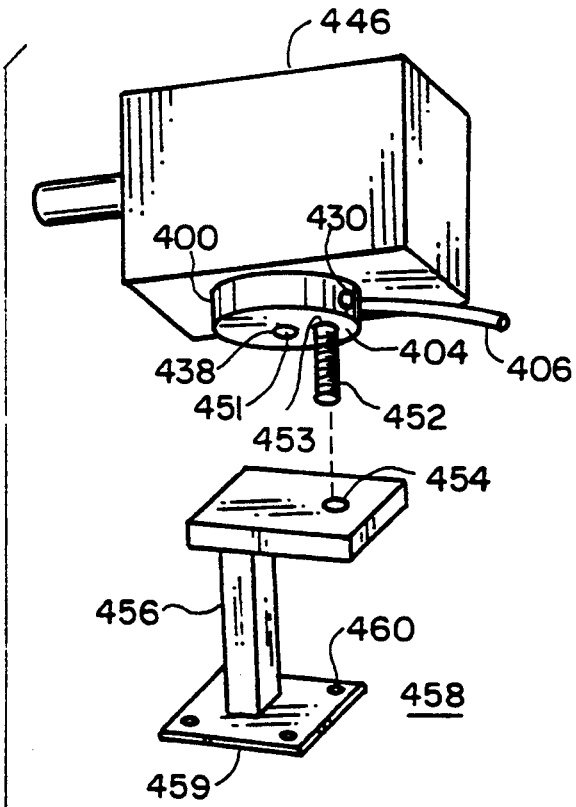
FIG. 33 is a perspective view of the sensor of FIG. 31 including a stud for engaging a stand to support a product.

FIG. 33 shows the sensor housing 400 including a stud 452 extending from a counterbore 453 (FIG. 31B) in the bottom side 404 of the sensor housing 400. The stud 452 is received in a hole 454 on a stand 456 which is mounted to a surface 458 by a base 459 having fasteners 460. The stand 456 holds the camcorder in a display position. The stud 452 is slidably received in the hole 454 on the stand. The sensor housing 400 operates as described above in conjunction with FIG. 32.

Figure 34:
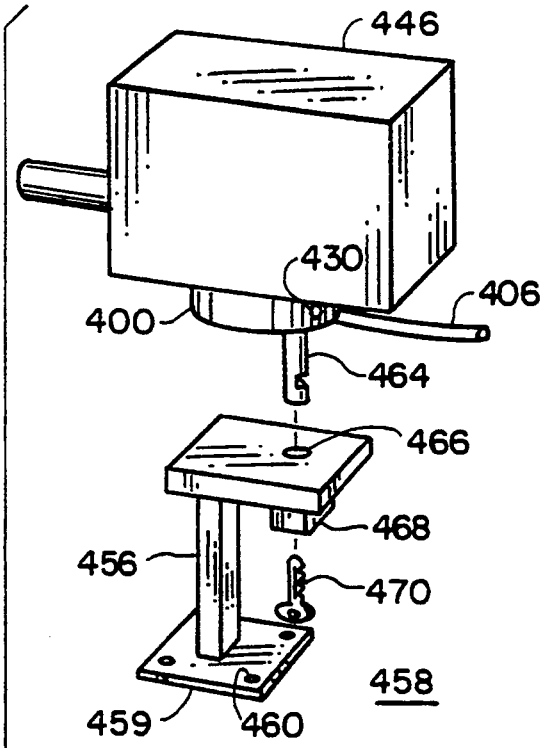
FIG. 34 is a perspective view of the sensor of FIG. 31 fastened to a product and including a locking stud for engaging a locking mechanism on a stand.

Alternatively, the sensor housing 400 could include a locking stud 464 extending therefrom as best seen in FIG. 34. The locking stud 464 is received in a hole 466 and engages a locking mechanism 468 actuated by a key 470. The sensor housing 400 operates as described above in conjunction with FIG. 32.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An alarm sensor for securing an object, said alarm sensor having a secured and an unsecured state, said sensor comprising:

a sensor housing having a planar surface with a peg projecting from said surface;

a connection means spaced from said peg for attaching the sensor housing to the object to be secured with the peg inserted into a recess in the object such that the object is prevented from rotating with respect to the sensor housing;

an elongate cord housing a first and second conductor and extending from the sensor housing for electrical communication with an alarm system;

a connecting mean for connecting an end of the elongate cord to a remotely located detector means for detecting the state of the sensor, said detecting means being part of said alarm system;

a limit switch connected to said first and second conductors and mounted to said sensor housing with a switch actuator projecting from the planar surface, said sensor being in the secured state when said limit switch actuator is depressed against said object; and a means on the sensor housing for visually indicating the state of the sensor.

2. The alarm sensor of claim 1 wherein the connection means is a bolt.

3. The alarm sensor of claim 1 wherein said sensor housing has a post extending from the bottom surface of said sensor housing for engaging a hole in a stand.

4. The alarm sensor of claim 3 further including a locking mechanism for engaging said post in the hole in said stand.

5. The alarm sensor of claim 1 wherein the alarm sensor is in the secured state when the limit switch connects the first and second conductors and in the unsecured state when the limit switch disconnects the first and second conductors.

6. The alarm sensor of claim 1 wherein the alarm sensor is in the secured state when the limit switch disconnects the first and second conductors and in the unsecured state when the limit switch connects the first and second conductors.

7. The alarm sensor of claim 1 further including a layer of material mounted between the sensor housing and the object for protecting a mounting surface of the object.

8. The alarm sensor for securing an object, said alarm sensor having a secured and an unsecured state, said sensor comprising:

a sensor housing having a top and bottom surface;

a peg projecting from the top surface of the sensor housing;

a post projecting from the bottom surface of the sensor housing;

a connection means spaced from said peg for attaching said top surface of the sensor housing to the face of the object to be secured with said peg inserted into a recess in the object such that the object cannot rotate with respect to said sensor housing;

an elongate cord housing a first and second conductor and extending from the sensor housing for electrical communication with an alarm system;

a connecting means for connecting an end of the elongate cord to a remotely located detector means for detecting the state of the sensor, said detecting means being part of said alarm system;

a limit switch connected to said first and second conductors and mounted to said sensor housing with a switch actuator projecting from the top surface, said sensor being in the secured state when said limit switch actuator is depressed against said object and the unsecured state when said limit switch is not depressed;

a stand having a hole for engaging said post, said stand for holding said object for display; and a means on the sensor housing for visually indicating the state of the sensor.

9. The alarm sensor of claim 8 wherein the sensor housing is a flat cylinder.

10. The alarm sensor of claim 9 wherein the connection means of the sensor housing includes a cylindrical hole for receiving a mounting screw.

* * * * *